US006257949B1

(12) United States Patent
Vickers

(10) Patent No.: US 6,257,949 B1
(45) Date of Patent: Jul. 10, 2001

(54) TUBULAR DEVICE THAT PRODUCES SOUND

(75) Inventor: Dean Scott Vickers, 211 Zinfandel Dr., Ukiah, CA (US) 95482

(73) Assignee: Dean Scott Vickers, Ukiah, CA (US)

( * ) Notice: Subject to any disclaimer, the term of this patent is extended or adjusted under 35 U.S.C. 154(b) by 0 days.

(21) Appl. No.: 09/618,443

(22) Filed: Jul. 18, 2000

Related U.S. Application Data

(60) Provisional application No. 60/165,843, filed on Nov. 16, 1999.

(51) Int. Cl.[7] ..... A63H 33/40
(52) U.S. Cl. ..... 446/202; 446/213
(58) Field of Search ..... 446/202, 205, 446/206, 207, 208, 213, 176, 404

(56) References Cited

U.S. PATENT DOCUMENTS 197,569 * 11/1877 Seabury ..... 446/202
370,496 * 9/1887 Seliger ..... 446/404
1,528,523 * 3/1925 Beck ..... 446/202
1,613,982 * 1/1927 Cohn ..... 446/205
3,991,513 * 11/1976 Faulk ..... 446/208
5,110,316 * 5/1992 Shaw et al. ..... 446/202
5,643,039 * 7/1997 McIntyre ..... 446/208
5,735,725 * 4/1998 Primos ..... 446/207
6,179,684 * 1/2001 Carlton ..... 446/207

* cited by examiner

*Primary Examiner*—Jacob K. Ackun, Jr.
*Assistant Examiner*—Faye Francis

(57) ABSTRACT

The present invention is a noise making device comprising a two-part tubular structure including a mouthpiece and a tube. The mouthpiece is connected to the tube in the lengthwise axis. During the course of user operation, the free-end of the tube is disposed into the users armpit and the mouthpiece is disposed to the user's mouth. Air is then blown into the mouthpiece through the lengthwise axis of the noisemaker and is expelled from the end of tube. This expulsion of air generates vibrations at the end of the tube, surface of the user's armpit and into the surrounding air. Such vibrations in turn generate sound. In addition, two slits have been applied in one end of the tube. Inclusion of these slits enhance the generation of the aforementioned vibrations and impart discrete sounds to the noisemaker.

5 Claims, 4 Drawing Sheets

TUBULAR DEVICE THAT PRODUCES SOUND

This application is claiming priority to the provisional application No. 60/165,843 filed on Nov. 16, 1999.

CROSS REFERENCED TO RELATED APPLICATIONS

| | | | |
|---|---|---|---|
| 4,116,108 | Sept., 1978 | Hyman | 84/330 |
| 4,151,678 | May., 1979 | Robertson | 46/180 |
| 5,630,744 | May., 1997 | Bandy | 446/202 |

BACKGROUND OF THE INVENTION

This invention relates generally to noise-making devices for amusement purposes. Specifically, to such noise-making devices that provide a system whereby blown air is routed through the noisemaker, wherein unusual variable sounds are created as said air is expelled.

As is well known in the art, various air-blown operated noisemakers have been used for amusement purposes. U.S. Pat. No. 5,630,744 to Bandy (1997) shows a toy gun device which when blown into provides sound in the direction the toy gun is pointed; U.S. Pat. No. 4,116,108 to Hyman (1978) shows a musical tube which is sounded by swinging the tube in the air; and U.S. Pat. No. 4,151,678 to Robertson (1979) shows a tubular duck calling device which is sounded by having air blown into it producing vibrations in an arrangement of internally positioned reeds and the surrounding air stream. In addition, well known wind musical instruments such as the clarinet and oboe are sounded by having air blown into and through them producing vibrations in the air stream. However, to the applicant's knowledge, there is no noise-making device designed to produce sound by the use of blown air in association with the human body as described herein, thereby providing such a new noise-making device.

It is the primary objective of this invention to provide an easy to use noisemaker allowing for the provision of unusual and variable sounds that are under the instant control of the user. It is also an object to provide a noisemaker that has relatively few operating parts and is simple and durable in construction, assemblage and use. A further object of this invention is to provide a noise-making device that is relatively inexpensive and simple to manufacture. A still further object is to provide a noisemaker that allows for compact storage on an individual basis as well as in large quantities for distribution purposes.

BRIEF SUMMARY OF THE INVENTION

In accordance with the invention herein claimed, a new and novel noise-making device is established for use in direct association with the human body. In broad terms, the invention is a noisemaker comprising a two-part and open-ended tubular device. The two-part embodiment is comprised of an interconnected rigid mouthpiece and flexible tube. Also provided in this embodiment is such a device wherein said noisemaker is constructed and arranged so that, when the free-end of the tube of the noisemaker is retained under the user's arm in the user's armpit and the mouthpiece is blown into by the user, discrete sounds are produced. Further provided with the accordance of this invention is such a device where such sounds are easily varied. The invention also comprises a noise-making device that produces sounds as the result of an individual user or multiple users. This effect can be applied to amusement, musical, and celebratory purposes.

BRIEF DESCRIPTION OF THE SEVERAL VIEWS OF THE DRAWINGS

For a more complete understanding of the noisemaker reference is now made to the following description and accompanying drawings, in which.

REFERENCE NUMERALS IN THE SEVERAL VIEWS OF THE DRAWINGS

Figure 1:
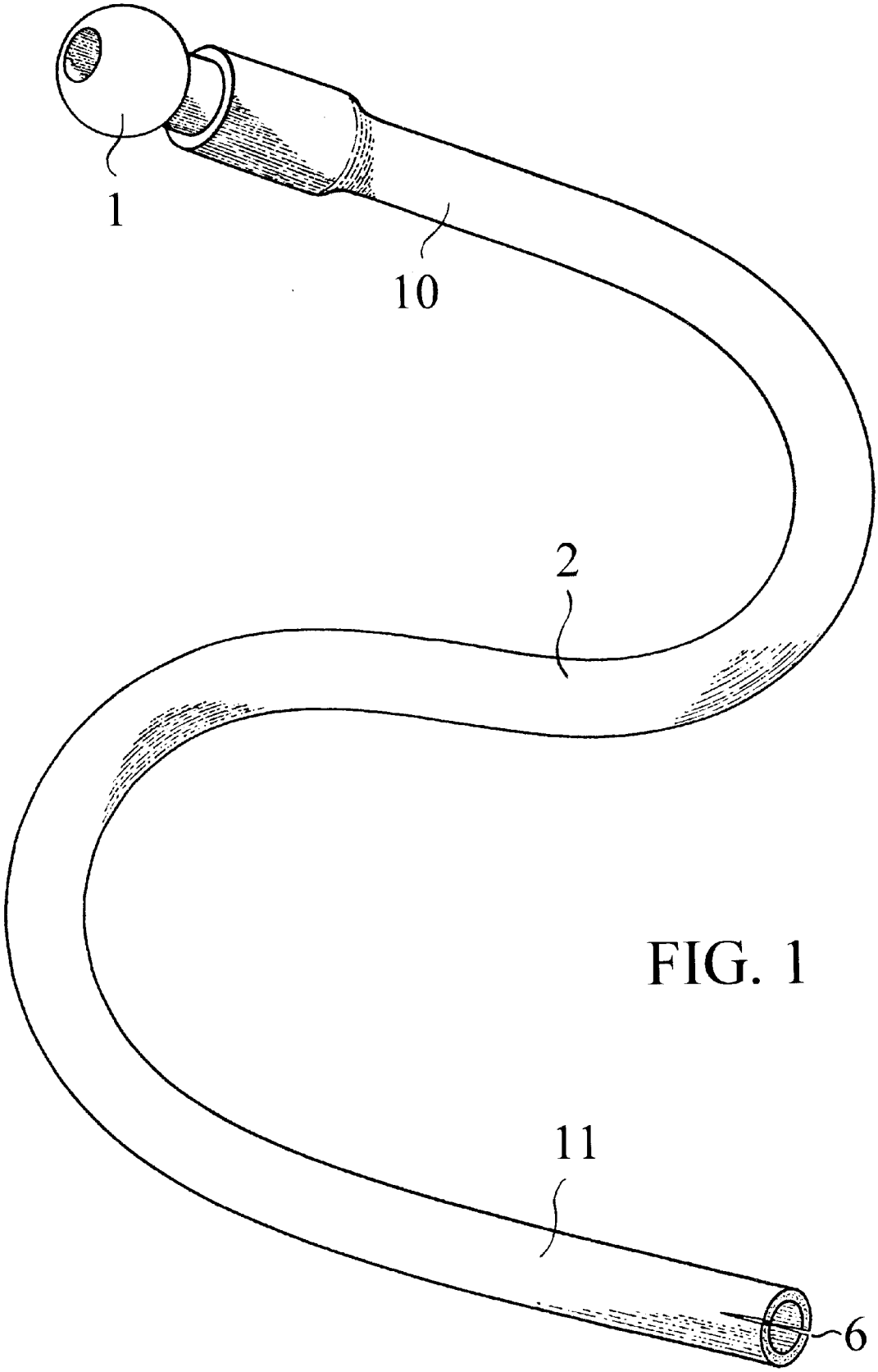
FIG. 1 is a perspective view of the fully assembled noisemaker.

1 mouthpiece
2 tube
3 spherical end of the mouthpiece
4 cylindrical end of the mouthpiece
5 round channel within the mouthpiece
6 slit
7 slit
8 tube cutoff surface
9 internal cavity of the tube
10 tube end void of slits
11 tube end with slits

DETAILED DESCRIPTION OF THE INVENTION

Figure 2:
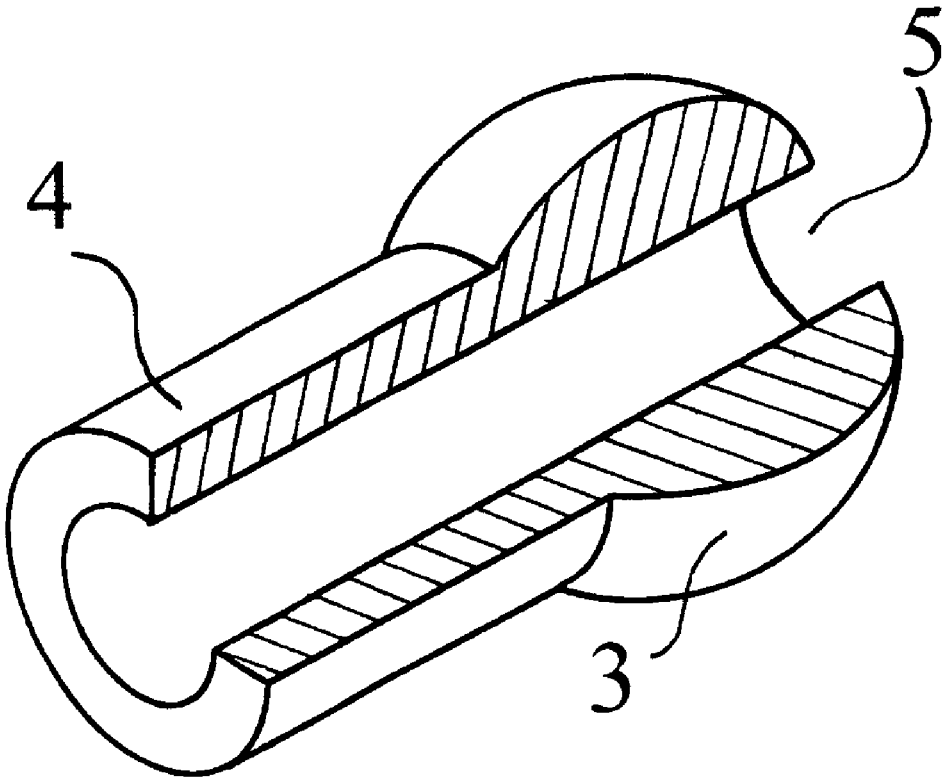
FIG. 2 shows an isometric half section of mouthpiece.
Figure 3:
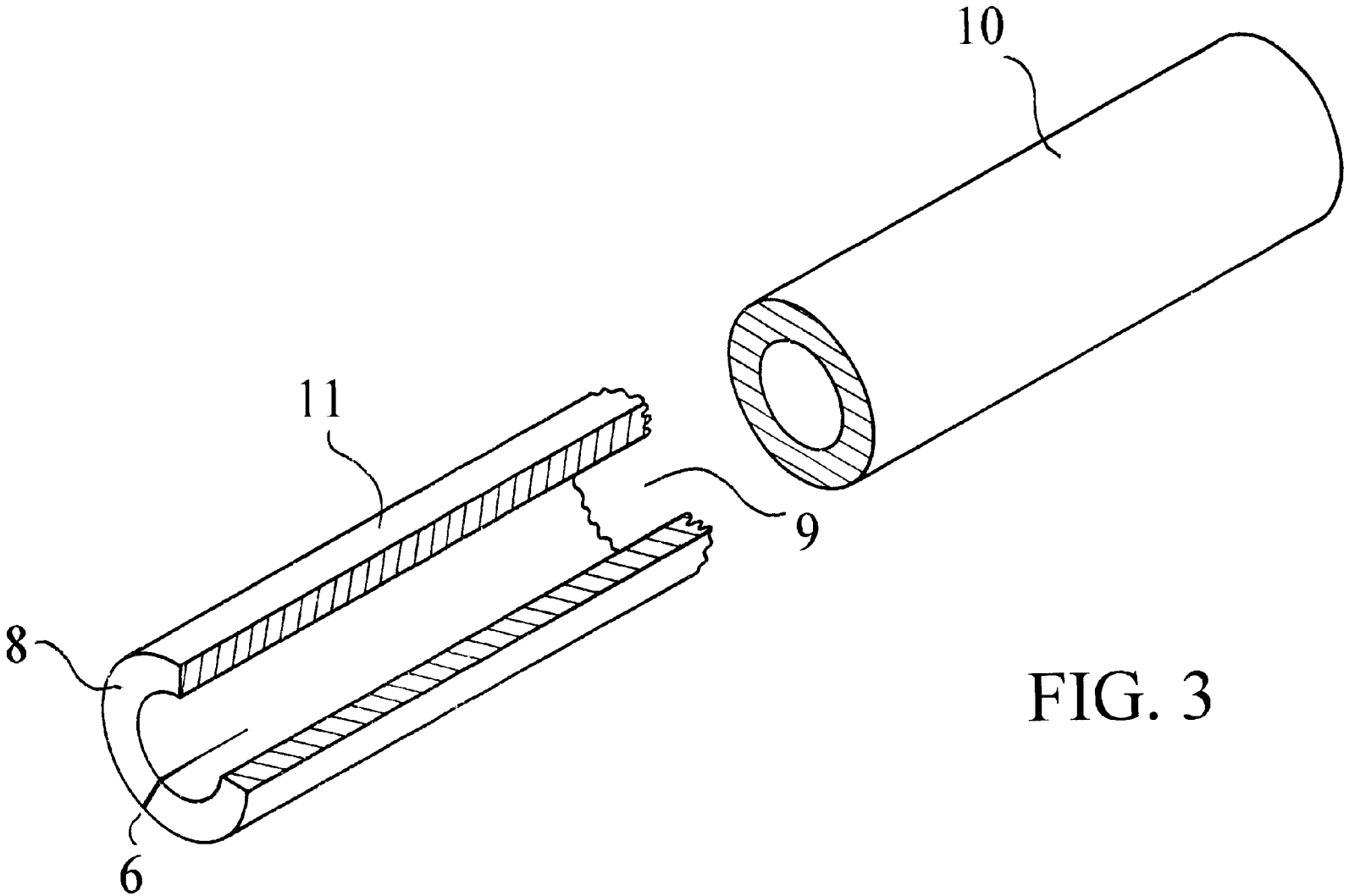
FIG. 3 shows an isometric half section of the tube.
Figure 4:
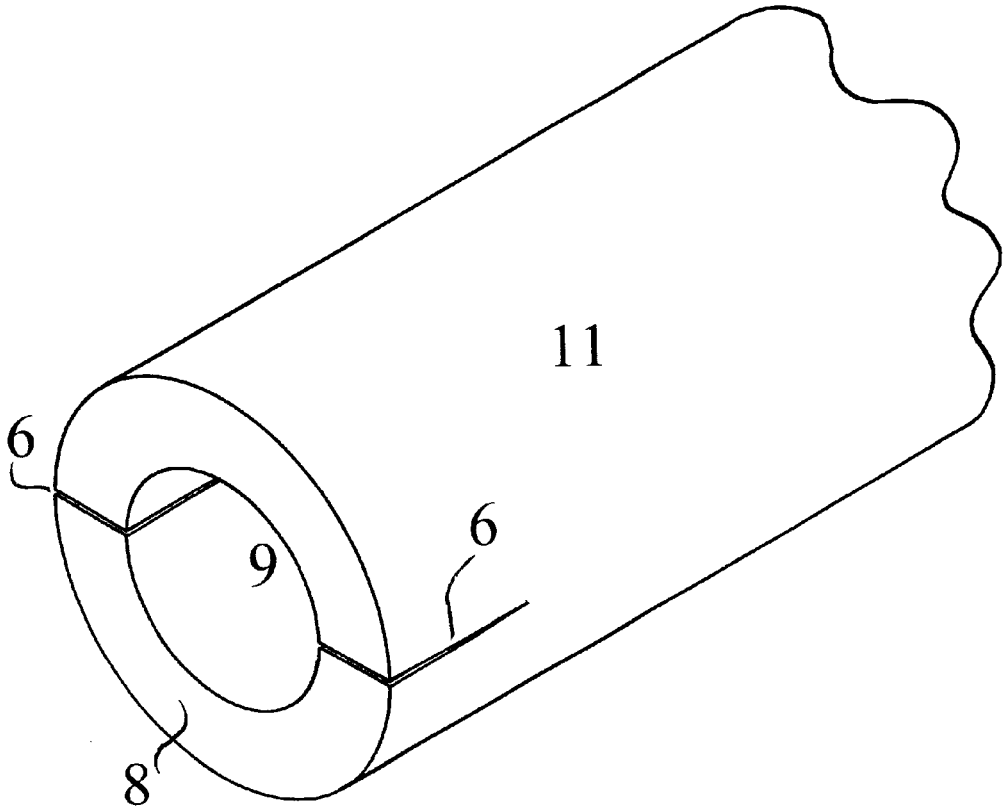
FIG. 4 shows a partial perspective view of the tube end showing detail of the slits.

The preferred embodiment of the noise-making device is illustrated in FIG. 1. It comprises a structure of two parts: a) mouthpiece (1) shown in FIG. 1 and 2; b) tube (2) shown in FIG. 1 and 3. Said mouthpiece (1) is comprised of a single rigid structure with a ¾ of one inch diameter spherical end (3) integrated with a ⅜ of one inch diameter by ¾ of one inch long cylindrical end (4) within the lengthwise axis. A round ¼ of one inch diameter channel (5), shown in FIG. 2, passes through the center of the entire lengthwise axis of the mouthpiece (1) and is open at both ends of the mouthpiece (1). The mouthpiece (I) is constructed of a nontoxic plastic such a polyvinyl chloride or similar material that can be manufactured by injection molding techniques. The tube (2) is designed as a ¼ of one inch inside diameter by 7⁄16 of one inch outside diameter by a 16 inch length of round straight tubing with open ends. The tube (2) is constructed of a nontoxic flexible plastic such as polyvinyl chloride or similar material that can be manufactured by extrusion or injection molding techniques and cut to length using simple tools such as scissors. Two slits (6) shown in FIG. 1 and 4 are cut into one end of the tube (2). Each of the slits (6) originate at the cutoff surface (8) of the tube (2) at points in the circumference that are one hundred and eighty degrees from each other. The slits (6) section through the entire wall thickness of the tube (2) and extend into the lengthwise axis of the tube (2) ¼ of one inch.

After the material is manufactured to produce the two parts, the assembler prepares the noise-making device in the following manner. Each part of the present invention is connected together to form the entire noise making device shown in FIG. 1. The cylindrical end of the mouthpiece (4) is placed into the internal cavity (9) of the tube end void of slits (10) to the extent of the cylindrical end of the mouthpiece (4) forming an imbricate connection shown in FIG. 1. The fully prepared invention is now operational.

To operate the present invention the user grips the mouthpiece (1) of the noisemaker in one hand. The user's arm of the aforementioned hand is raised to expose the surface of the user's armpit. The flexible tube end with slits (11) is held by the hand the of user's unraised arm and disposed onto the center of the user's armpit surface. The user's raised arm is then lowered, simultaneously releasing the hand retaining the tube end with slits (11). The result of the aforementioned action disposes the medial surface of the user's arm into contact with the lateral surface of the users chest facilitating the retention of the tube end with slits (11) within the user's armpit. The hand of the unraised arm is free to make any adjustment in the disposition of the noisemaker. The user disposes the mouthpiece (1) to the lips of the user's mouth. The user then blows air through the lips into the round and open channel (5) of the cylindrical end (4) of the mouthpiece (4). This action imparts mechanical energy and movement in the column of air through the lengthwise axis of the noisemaker. Retention of the tube end with the slits (11) within said user's armpit confines the aforementioned air movement. Continued application of blown air results in an increase in air pressure within the tube. As the force of the blown air is increased it eventually increases the air pressure to a point where the movement of air overcomes the confines of the user's armpit and air is expelled from the noisemaker. In the course of this action the aforementioned mechanical energy imparts vibrations to the surfaces of the tube and user's armpit and in turn to the surrounding air, resulting in the generation of sounds. A vital feature of the noisemaker is the application of the two slits (6) in the tube end. The slits form two flap-like structures and function similar to the reed arrangement in some wind instruments, such as the oboe and clarinet, wherein having air blown into these instruments vibrates the reeds and in turn the air stream which results in the production of sound. Air blown into the noisemaker vibrates the so-called flaps and in turn the air stream, producing sound. In addition, the vibratory action of the flaps impacts the surface of the armpit skin surface which also imparts vibrations thus further enhancing the generated sound. An increase or decrease in the force of the air blown into the noisemaker reciprocates with an increase or a decrease in the aforementioned vibratory action. In addition, alteration of the disposition of the tube end with slits within the user's armpit in combination with an increase or decrease in the pressure applied by the lowered arm of the user's armpit in retention the tube end with slits, will modulate the vibratory actions and sounds produced. The concerted effect of the vibratory actions and the aforementioned adjustments offer the user unlimited control of the noisemaker with variable and discrete sound production. Subsequent practice results in the ability of such a noisemaker to function as a rhythmic, harmonic, or melodic instrument that can be performed by a single user or by multiple users with identical noisemakers in a harmonious manner.

Wall thickness of the tube equal to the specified dimension is an important consideration in the operation of the noisemaker. Larger wall thickness decreases the flexibility of the tube reciprocating with the same effect on the so-called flaps in decreasing the said vibratory action hence diminishing sound production. In addition, thinner tube wall thickness decreases flexible tube lengthwise rigidity. This characteristic would increase the potential for collapse of the tube wall as the noisemaker is bent and contorted during use. Thus obstructing or restricting the blown airflow and again, degrading vibratory action and sound production.

Ramification's and Scope

Accordingly, the present invention fulfills all of the attributes of an excellent noise-making device:

Economy:

The noisemaker is comprised of synthetic material that are readily available and easily manufactured. Market values may vary from manufacturer to manufacturer but estimates show production costs from small a small quantity of 5000 in the 1999 market to be less that $0.50 per unit. Larger lots can be produced at much lower levels. Based on the specified dimensions of said noisemaker, over 132 units can be stored in the flat state in a standard container measuring 12 inches by 12 inches by 18 inches. In addition, said noisemaker can be distributed as a two-part entity relying on user assemblage hence further reducing manufacturing expense.

Portability:

The noisemaker is compact, lightweight and flexible making it very portable and easy to use. The noisemaker can be rolled to fit in the user's pocket when not in use.

Durability:

Prototypes constructed have been tested over a three month period with no degradation in integrity of the device.

Simplicity:

Assemblage of the two parts is accomplished in less that ten seconds. When tested with young children, the noisemaker was easy to use. 7 year olds can prepare the noisemaker I in less than 15 seconds and with little instruction can produce a multitude of noises. Competent skill is achieved in a short period of time. The 2-part semi-permenent assemblage of the noisemaker allows for no lost parts.

Promotional Appeal:

The noisemaker has unlimited uses. It can be operated by an individual of any age. Musical and amusement potential of the noisemaker can be applied to single or concerted use. When used on a large scale the users have the satisfaction of being synchronized in their efforts. Sports organizations could benefit from the distinctive audible characters of the noisemaker providing ideal crowd heckling and celebratory methods. Small gatherings make for and ideal situation where noise-makes are appropriate as entertainment devices. In addition, printed advertisement can be applied to the external surface of the noisemaker for marketing appeal. In situations where organizations demand a high-volume promotional item, the noisemakers portability makes for key Consideration.

Although the description above contains specificity's, they should not be construed as limiting the scope of the invention but as merely providing illustrations of the presently preferred embodiments of this invention. For example other materials may be identified which will be less expensive, more durable, of different dimensions, provide for more colors and color patterns, are safer to use, and so on. In addition, a variety of modifications are possible to the noisemaker including different shapes and ornamentation including, the inclusion of an additional tube to satisfy use in both armpits.

Thus the scope of this invention should be determined by the appended claims and their legal equivalents, rather that through given examples.

What I claim as my invention is as follows:

1. A tubular noise-making device comprising a mouthpiece and a tube, wherein said mouthpiece comprises a sphere and a cylindrical stem that are integral within a lengthwise axis, of said mouthpiece having a round and open channel passing through a center of the lengthwise axis, said tube having two open ends and surrounding an internal column of air, said tube having two slits disposed in one of said two open ends, and said slits originate from said one end of said tube at points one hundred and eighty degrees from each other surface extending along the tube in a lengthwise direction to a length of between ¼ to ⅜ of one inch.

2. The noise-making device of claim 1, wherein said mouthpiece is rigid having selected dimensions.

3. The noise-making device of claim 1, wherein said tube is flexible having a diameter and length of selected dimensions and a wall thickness from 3/64 to /1/16 of one inch.

4. A method of preparing said noise-making device of claim 1 comprising the steps of:

a) providing the noise-making device of claim 1;

b) providing said tube having an inside diameter that is less than that of the outside diameter of said cylindrical stem of the mouthpiece, and placing said cylindrical stem of the mouthpiece into the internal cavity of the one end of said tube devoid of slits and thereby forming an imbricate connection.

5. A method of operating a noise-making device comprising the steps of:

a) providing the noise-making device as defined in claim 1;

b) raising one of two user's arms exposing the surface of the user's armpit and disposing said tube end with slits onto the center of said user's armpit surface;

c) lowering said raised user's arm retaining said tube end with slits in said user's armpit;

d) blowing into said mouthpiece, generating movement of air through a lengthwise axis of said noise-making device, resulting in expulsion of air from said tube end with slits;

e) retaining said tube end with slits in said user's armpit, restricting said expulsion of air from said tube end with slits, generating vibrations in said surfaces of user's armpit and said noise-making device, producing sounds; and h) increasing or decreasing the force of said air blown into said noisemaking device in conjunction with alterations of the disposition of said tube end with slits in said user's armpit producing variations of said sounds.

* * * * *